US008487458B2

(12) United States Patent
Steele et al.

(10) Patent No.: US 8,487,458 B2
(45) Date of Patent: Jul. 16, 2013

(54) TWO SPEED CONTROL FOR MOBILE REFRIGERATION GENERATORS

(75) Inventors: John T. Steele, Marcellus, NY (US); Peter P. Guzman, Marcellus, NY (US); Jeffrey J. Burchill, Syracuse, NY (US); Martin Murphy Mertell, Liverpool, NY (US); Douglas R. Auyer, Clay, NY (US); Cheryl M. Keiling, Camillus, NY (US)

(73) Assignee: Carrier Corporation, Farmington, CT (US)

( * ) Notice: Subject to any disclaimer, the term of this patent is extended or adjusted under 35 U.S.C. 154(b) by 249 days.

(21) Appl. No.: 12/812,666

(22) PCT Filed: Jan. 17, 2008

(86) PCT No.: PCT/US2008/051299

§ 371 (c)(1),
(2), (4) Date: Jul. 13, 2010

(87) PCT Pub. No.: WO2009/091396

PCT Pub. Date: Jul. 23, 2009

(65) Prior Publication Data

US 2010/0289273 A1 Nov. 18, 2010

(51) Int. Cl.
*F02D 29/06* (2006.01)

(52) U.S. Cl.
USPC ..... 290/40 B

(58) Field of Classification Search
USPC ..... 290/40 F, 40 C, 40 B; 123/376, 41.01; 60/912
See application file for complete search history.

(56) References Cited

U.S. PATENT DOCUMENTS

| | | | | |
|---|---|---|---|---|
| 2,488,171 | A | 11/1949 | Campbell | |
| 2,803,757 | A | 8/1957 | McFarland | |
| 5,291,745 | A * | 3/1994 | Hanson | 62/89 |
| 5,657,638 | A * | 8/1997 | Erdman et al. | 62/182 |
| 6,226,998 | B1 | 5/2001 | Reason et al. | |
| 6,813,897 | B1 | 11/2004 | Bash et al. | |
| 2002/0020181 | A1 * | 2/2002 | Ewert et al. | 62/228.4 |
| 2006/0118084 | A1 | 6/2006 | Asakage | |
| 2007/0101735 | A1 * | 5/2007 | Matsui et al. | 62/160 |

OTHER PUBLICATIONS

International Search Report and Written Opinion mailed Jul. 8, 2008 (9 pgs.).

International Preliminary Report on Patentability issued Jul. 20, 2010 (5 pgs.).

* cited by examiner

*Primary Examiner* — Tulsidas C Patel
*Assistant Examiner* — Viet Nguyen
(74) *Attorney, Agent, or Firm* — Cantor Colburn LLP

(57) ABSTRACT

A current sensor is installed in a generator set to measure the current being delivered from the generator set to a refrigeration unit. A control is responsive to the current transformer to reduce the speed of the drive engine to a lower speed when the current being delivered to the refrigeration unit is determined to be below a predetermined higher level. Provision is made to override the system when the sensed current is determined to be transient caused or in the event that ambient temperature is determined to be above a predetermined temperature threshold.

11 Claims, 5 Drawing Sheets

TWO SPEED CONTROL FOR MOBILE REFRIGERATION GENERATORS

TECHNICAL FIELD

This invention relates generally to transport refrigeration systems and, more particularly, to speed control of a motor/generator therefor.

BACKGROUND OF THE INVENTION

An all electric mobile refrigeration unit or refrigerated container uses an auxiliary generator set to power the unit when traveling by rail or road. That is, whereas, when such a unit is being transported on board ship it is provided electrical power by way of the ships power, but when the container is being transported by rail car or by truck, no such electrical power is available. Accordingly, electrical power is provided by way of a motor/generator set during such period.

Unlike a truck/trailer refrigeration system, which is integrated and includes an overall control system for controlling all of the various components including the refrigeration system and the generator, the engine/generator set in a refrigerated container is a stand alone unit which does not communicate with the refrigeration system. This problem is exacerbated by the fact that various types of refrigeration units will be electrically powered by such an engine/generator set, with each such refrigeration system having its own unique operating characteristics. Accordingly, heretofore, there has been no unifying control system for communicating between the refrigeration system and the engine/generator set.

For this reason, in order to ensure that sufficient power is being delivered to the refrigeration system, the engine/generator set has been operated at a single, relatively high, speed at all times, even though the refrigeration unit may be operating under light load conditions or even in an off condition if the load requirements have been met. In this regard, the applicants have made studies which indicate that such a unit is typically lightly loaded for a majority of the time (i.e. up to 70% or more). However, a relatively large engine has been required to provide the power at high load conditions such as for pull down. The unit is therefore oversized for lighter load conditions, thereby resulting in inefficient fuel use.

DISCLOSURE OF THE INVENTION

According to one aspect of the invention, provision is made to sense the level of current being delivered by the generator to the refrigeration system, and if the current is below a predetermined high level threshold, then the speed of the generator drive engine is reduced to a lower level.

In accordance with another aspect of the invention, a timing function is included in order to eliminate short cycling of the system as may be caused by transients.

By yet another aspect of the invention, provision is made to measure the ambient temperature and, if it exceeds a predetermined level, the system is prevented from switching into a lower speed.

In the drawings as hereinafter described, a preferred embodiment is depicted; however, various other modifications and alternate constructions can be made thereto without departing from the spirit and scope of the invention.

DETAILED DESCRIPTION OF THE INVENTION

Figure 1:
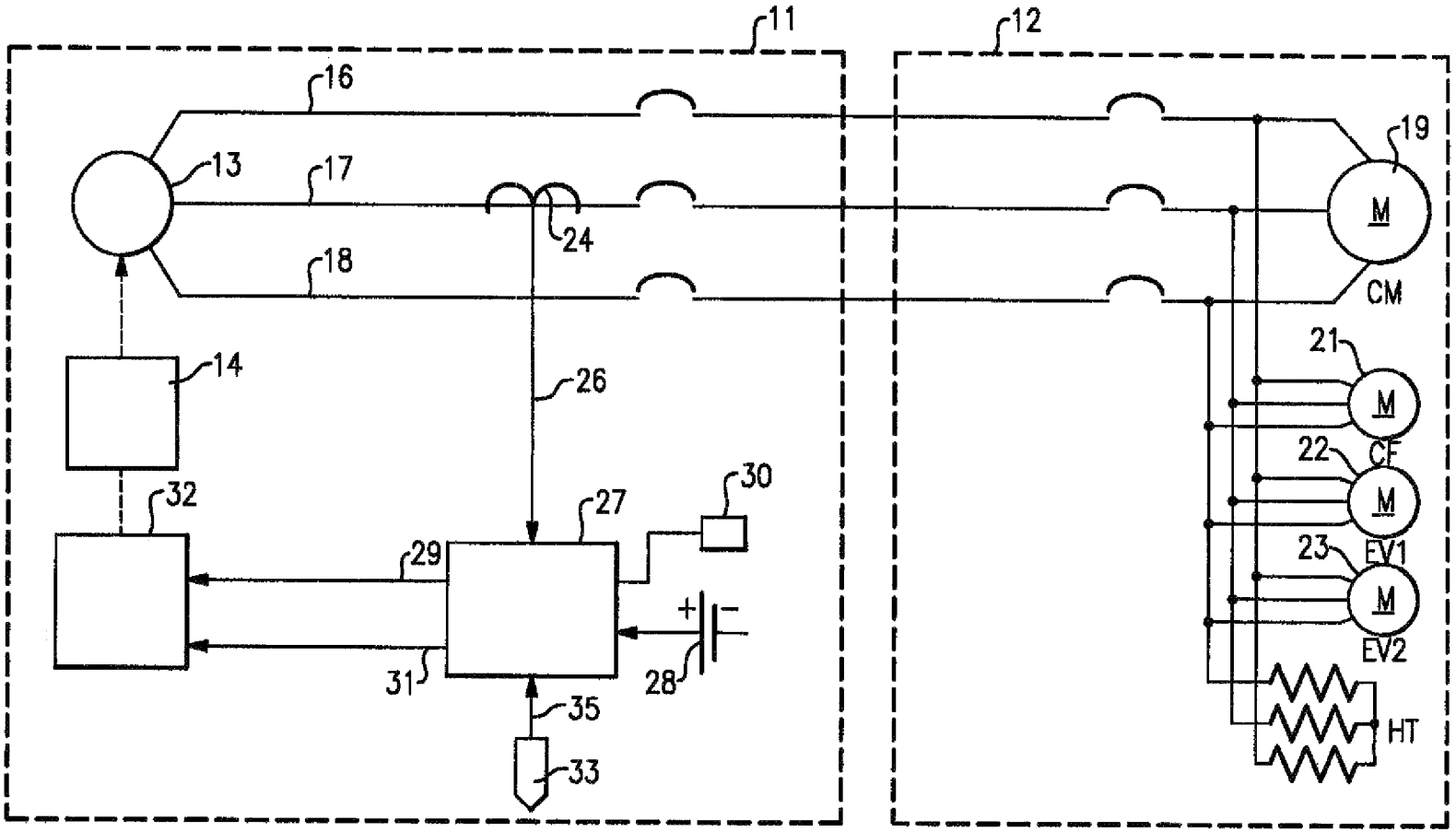
FIG. 1 is a schematic illustration of the container refrigeration unit and its associated generator set with the present invention incorporated therein.

The electrical interconnection between a generator set 11 and a container refrigeration unit 12 is shown in FIG. 1. Such a three wire connection is standard in the industry, and, rather than a single generator set being primarily associated with a single container unit, the various generator sets and container units are customarily interchanged, such that a single generator set will commonly be used with various types and brands of container refrigeration units. For these and other reasons, there has been no standardized communication between the standard generator set 11 and container refrigeration unit 12. Accordingly, the generator set 11 has, heretofore, had no knowledge of the operating condition of the container refrigeration unit 12.

The generator set 11 includes a generator 13 and a driving mechanism 14, which may be any of various types, such as a diesel engine, an electric motor or a turbine, for example. The electrical output of the generator is provided along lines 16, 17 and 18 which are electrically connected into the container refrigeration unit 12.

The container refrigeration unit 12 has incorporated therein a standard refrigeration circuit which includes, in serial flow relationship, a compressor, a condenser, an expansion device, and an evaporator (not shown). The evaporator fluidly communicates with the air in the container and operates to cool the space within the container to a desired temperature level for the preservation of its cargo.

Although this invention is being described in terms of a standard refrigeration circuit, it should be understood that it may equally be applicable to other types of cooling systems.

Within the container refrigeration unit, the compressor, as well as the fans for the condenser and the evaporator, are powered by electrical motors. Thus, when the generator set 11 is electrically connected to the container refrigeration unit 12, the power from the line 16, 17 and 18 is electrically connected to the compressor motor 19, the condenser fan motor 21 and the evaporator fan motors 22 and 23. The amount of power being used by the motors 19-23 depends on the operating mode of the container refrigeration unit 12 which, in turn, depends on various factors such as the ambient temperature, the amount of cargo in the container, the desired temperature or set point within the container, and other factors. Since, in the past, there was no way for the generator set 11 to know what the demand was in the container refrigeration unit 12, it was necessary to assume that it was operating at its maximum capacity. Accordingly, the driving mechanism 14 needed to be operated at a high speed in order to ensure that the generator 13 would be providing electrical power sufficient to operate the container refrigeration unit 12 at maximum capacity.

In order to provide an indication of the electrical load on the container refrigeration unit 12 (i.e. the amount of electrical power being used by the motors 19-23), a current sensing device 24, such as a current transformer is provided on one of the wires 17 to sense the amount of current being delivered from the generator set 11 to the container refrigeration unit 12. A representative signal is then sent along line 26 to a controller 27 which is powered by a voltage source 28, typically a 12 volt dc battery. The controller 27 then responsively sends an appropriate signal i.e. either a high speed output along line 29 or a low speed output along line 31 to an engine control 32, which then provides an input to the driving mechanism 14 to operate either at a high speed or at a lower speed in a manner as to be described hereinafter.

It should also be mentioned that, in addition to the current level signal on line 26, the controller 27 also receives a signal along line 35 from a temperature transducer 33 indicating the ambient temperature.

Figure 2A:
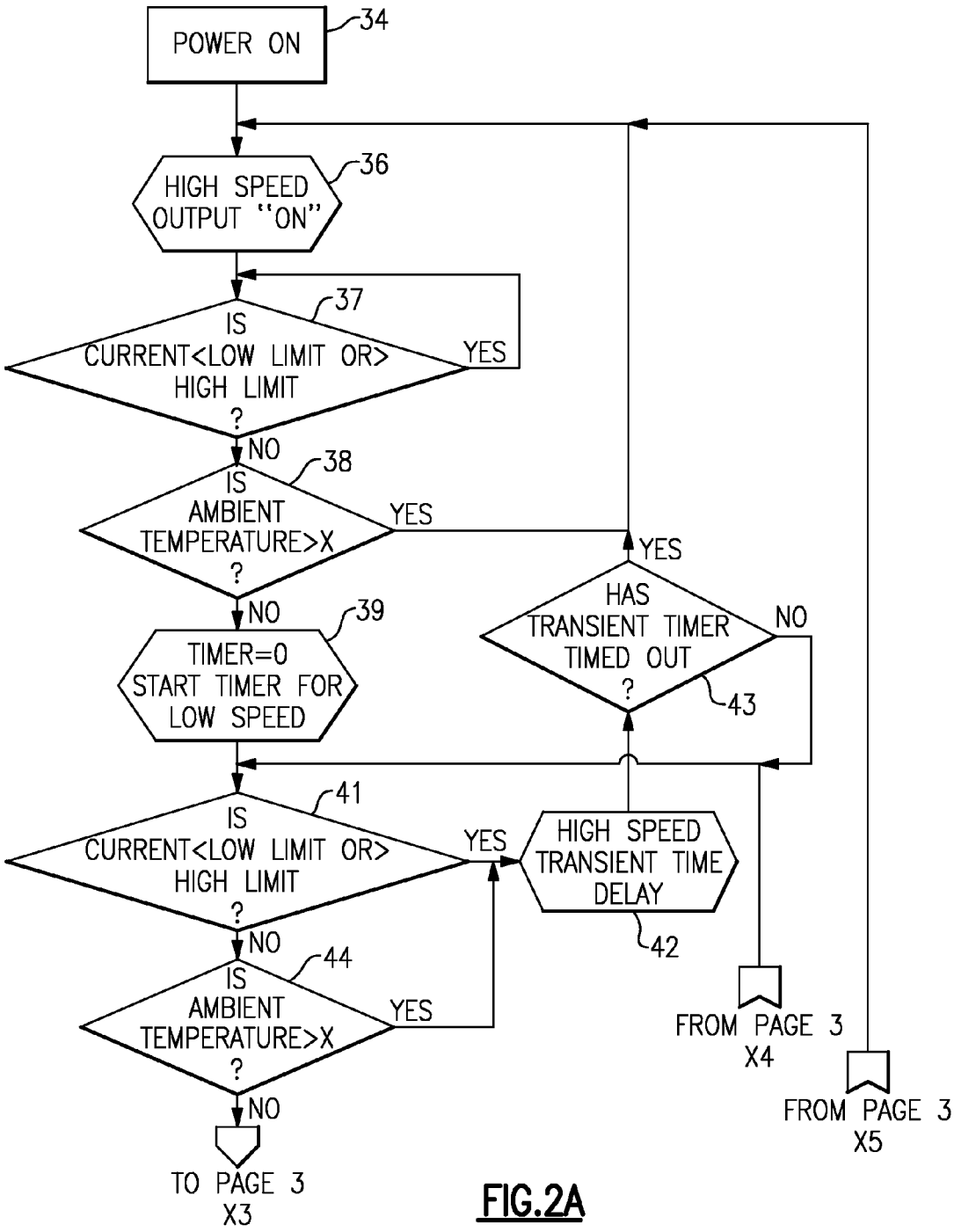
FIGS. 2A and 2B are block diagrams illustrating the method of control in accordance with the present invention.
Figure 2B:
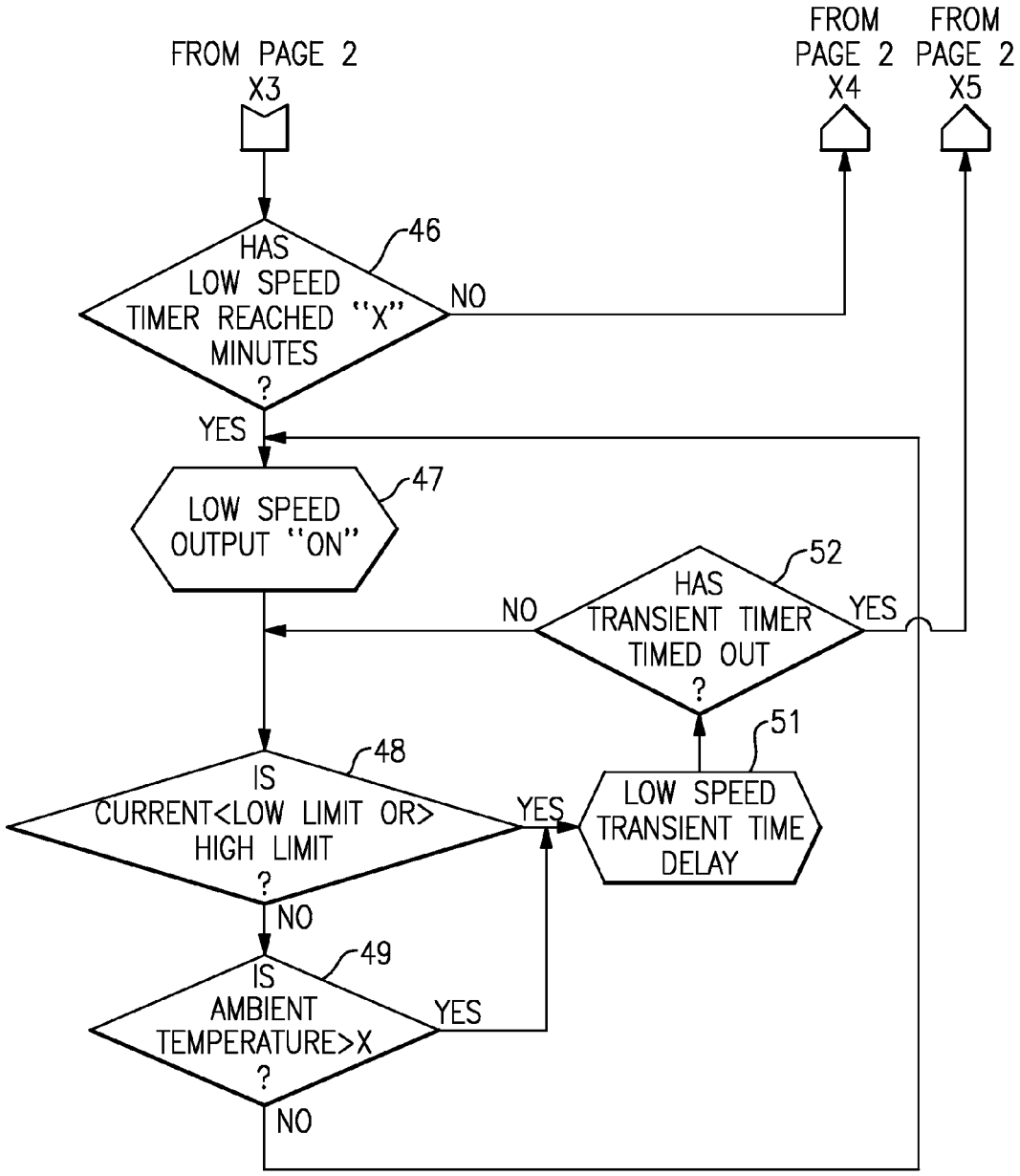

Referring now to FIGS. 2A-2C, there is shown a flow chart of the logic contained within the controller 27. Again, the controller 27 operates in response to the sensed current along line 26, and to the ambient temperature signal received along line 35, to send either a high or low speed signal to the engine control 32. Timing functions are also added to eliminate the effect of transients which could cause frequent cycling.

In block 34 the power from the voltage source 28 is turned on to thereby initialize all logic. Any time the control power is turned off, all logic will be reset. In block 36, the controller 27 will send a high speed output to the engine control such that the driving mechanism 14 will initially be started at high speed.

In block 37, the control 27 will sense, by the use of comparators or the like, whether the current being sensed by the current sensing device 24 is below a low limit or above a high limit. The low limit threshold is simply to determine whether the container refrigeration unit 12 is operating in a normal range. For example, if the fan motors 21-23 have been started but the compressor motor 19 has not yet been started, there will be very little electrical power being drawn from the generator set 11, and the control logic will therefore not proceed.

The high limit referred to in block 37 is the established threshold which determines whether the controller 27 will provide a high speed output along line 29 or a low speed output along line 31. Thus, if the sensed current is below the high limit threshold (as will be more fully explained hereinafter), then the logic will proceed toward the change in the engine control 32 to adjust the engine speed to a lower speed. Before this occurs, it is necessary to determine whether the ambient temperature is above a predetermined level, which would indicate that the outdoor temperature is too hot to allow the system to operate at a low speed. Thus, if the temperature is over that threshold, such as, for example, 85° F., then the logic is directed back to block 36 which will cause the engine to continue to operate at high speed. In this regard, it should be recognized that higher ambient temperatures cause higher compressor head pressures, which, in turn, result in higher current delivery.

If the ambient temperature does not exceed the established high limit threshold, then the logic proceeds to block 39 where a timer is started for purposes of determining whether the present sensed condition is provided by a transient or whether it is a steady state condition.

After the timer is started in block 39, the control 27 continues to query whether the sensed current is within the prescribed window as shown in block 41. Further, the sensed ambient temperature continues to be provided to the control 27 as shown in block 44.

If, in block 41, it is determined by the controller that the sensed current is now outside the established window, or in block 44 that the ambient temperature now exceeds the predetermined upper limit threshold, then the logic passes to block 42 to ensure that the timer is not reset due to transients. After passing to block 43, it is then determined whether the transient timer has timed out and if so, it is determined that it was not a transient current, and the low speed timer is reset. If, on the other hand, the transient timer is not timed out, then it is necessary to keep checking to see if the current goes into low speed range.

At block 46, a query is made as to whether the low speed timer has reached a predetermined threshold of time. In this regard, if the conservation of fuel is a priority, and other factors, such as a history of predominately low demand operation, are present, then a relatively short period of time such as 30 minutes may be established as the low speed time threshold. On the other, if, for various reasons, it is expected that the system will be operating at a high demand level for a greater period of time, then a higher threshold of time, such as 3 hours will be established as the low speed time threshold.

If the low speed time threshold has not been reached, the system cycles back to block 41. If the established time period has elapsed, then the controller 27 sends a low speed output signal along line 31 as indicated in block 47. The engine control 32 will then change the speed of the engine 14 to a lower speed, at which it will continue to run so long as the sensed current at the current sensing device 24 remains within the established window as indicated at block 48 and the ambient temperature is not determined to exceed the predetermined threshold as indicated at block 49. If either the sensed current is determined to be outside of the window, or the temperature exceeds the predetermined level, the logic proceeds to block 51 to set a low speed transient time delay to ensure that the timer is not reset due to transients. In block 52, if the transient timer has not timed out, then it is determined that the indication at block 48 or 49 was caused by a transient, and the system remains in low speed operation. If, on the other hand, the transient timer has timed out, that would be an indication that the signal is not caused by a transient and the system would then go back to high speed operation and the low speed timer would be reset.

From the discussion above, it should be recognized that these are three separate timers which are included in the system. In block 39, a first timer is set at a time in which it is desired to switch from high speed to low speed. This will typically be in a range from 30 minutes to 3 hours. In block 42, a second timer is set to establish a high speed transient time delay to ensure that the sensed current which was determined to be outside the window in block 41 was not caused by a transient. In block 51, a third timer is set to establish a low speed transient time delay to ensure that the sensing of the current to be outside of the window in block 48 was not caused by transient operation. In each of the latter two timers, a time of 3 to 5 minutes would be typical.

Considering now the relationship between the current being delivered by the generator set 11 and the operational mode of the container refrigeration unit 12, in the table set forth below, various operational conditions are shown with an indication of the typical current draw that is required to maintain that operational condition.

TABLE 1

| CURRENT | MODE OF OPERATION |
|---|---|
| 26 A | Pull-down<br>High ambient operation<br>Current Limit: 21 A, 23 A |
| 20 A | Perishable (steady state)<br>Frozen (steady state)<br>Current Limit 15 A, 17 A, 18 A, 19 A |
| 14 A | Defrost<br>Frozen Economy<br>Current Limit 13.5 A |

Figure 3:
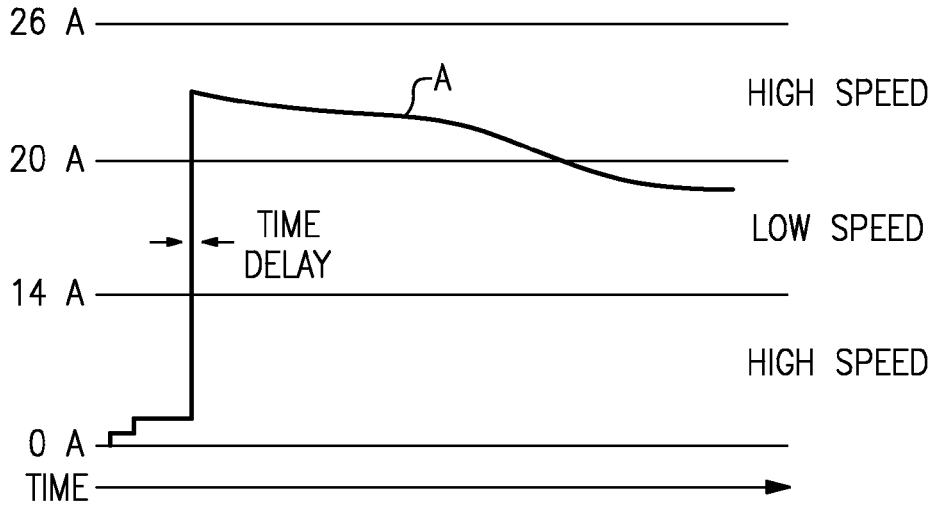
FIG. 3 is a graphic illustration of the current levels during start up operation.
Figure 4:
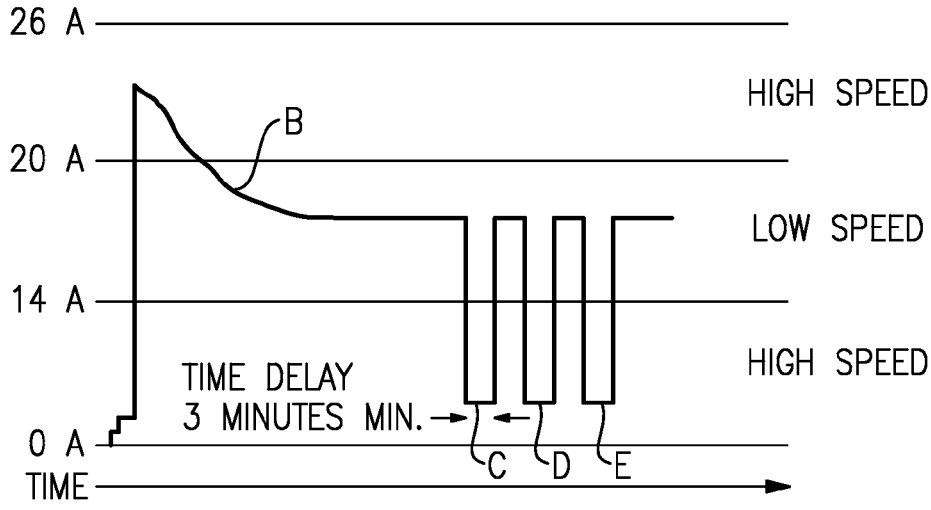
FIG. 4 is a graphic illustration of the current levels during transitional and transient operation.
Figure 5:
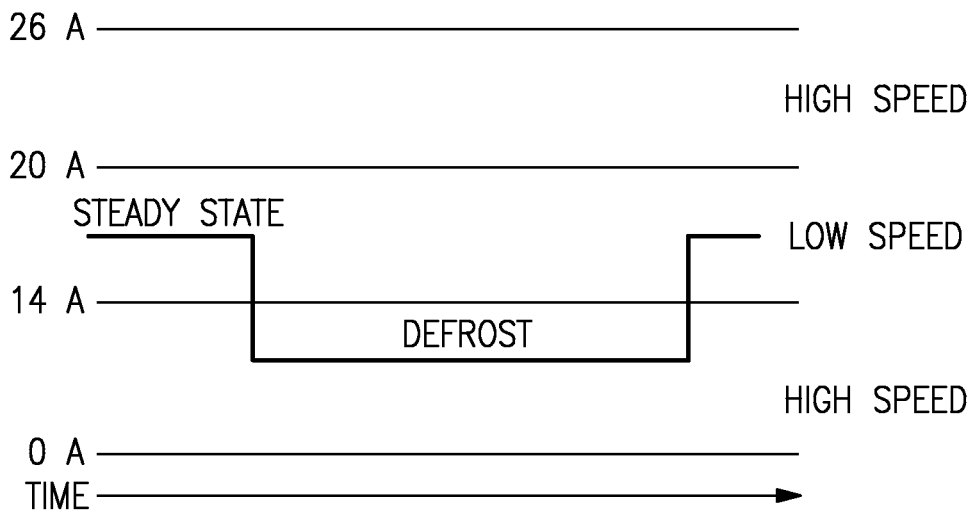
FIG. 5 is a graphic illustration of the current levels during defrost mode of operation.

Considering now the above relationships, the changing between high and low speed operations by way of the controller 27 during typical operation cycles are shown in FIGS. 3-5.

In FIG. 3, a typical start up operation is shown wherein at time=0, the system is started at high speed with the current draw initially being 0 and then ramping up as the various motors 19-23 are brought into play. The start up may occur in a pull-down situation where the temperature condition in the container is relatively high. Alternatively, it could be a situation where the system was temporarily shut down because the set temperature had been met. In any case, the typical current draw for start up is shown to be about 23 amps and, after the low speed timer has timed out, the control 27 sends the low speed output to the engine control 32 and the engine control 32 acts to slow down the drive mechanism 14. The result is that the sensed current is decreased down to below the 20 amp level as shown by the line A. It will remain at that level until conditions change so as to cause the controller 27 to increase the speed of the engine.

In FIG. 4, the current is decreased from a high speed level down to a low speed level as indicated by the line B. The downward and upward spikes are an indication of transients which would indicate a need to go to a high speed if the sensed current drops below the window as indicated at C, D and E. However, since the time that elapsed did not reach the established threshold, it was determined that they were transient caused, and so the control allowed continued low speed operation.

In FIG. 5, the system is shown as running in the low speed range until it is caused to operate in a defrost mode. It then switched to high speed operation and remained there until defrost was complete, at which time the algorithm caused it to switch back to low speed operation.

Referring again to FIG. 1, there is shown a disabling unit 30 which is connected to the control 27 for disabling the logic described above. Such a unit may be by way of a manual switch or an electrical control to disable the above described function such that it only operates when the system is operating in high speed.

Although the present invention has been described in terms of use with a transport refrigeration system, it should be understood that it is equally applicable to other types of refrigeration systems such as stationary refrigeration systems of the type found in supermarkets and the like, as well as comfort systems such as air conditioning and heat pump systems. Further, although described in terms of a single speed charge step, it should be understood that multiple, sequential steps may be taken between desirable limits such as 1800 RPM (60 Hz)-1700 RPM-1600 RPM-1500 RPM (50 Hz).

While the present invention has been particularly shown and described with reference to a preferred embodiment as illustrated in the drawings, it will be understood by one skilled in the art that various changes in detail may be effected therein without departing from the spirit and scope of the invention as defined by the claims.

We claim:

1. A method of controlling the speed of a drive mechanism for a generator supplying electrical power to components of a refrigeration system, comprising the steps of:

establishing a predetermined high threshold level of current as an indication of load in the generator;

sensing the level of current being delivered by the generator to the refrigeration system;

when the sensed level is equal to or below said predetermined high threshold, reducing the speed of said drive mechanism to a lower level; and initiating a timer and, if the sensed current condition does not persist for a predetermined period of time, determining that it was transient caused and preventing the changing of speed for that reason.

2. The method as set forth in claim 1 and including an initial step of starting the drive mechanism at a higher speed.

3. The method as set forth in claim 1 and including:

determining whether the sensed level of current is less than a predetermined lower threshold and if so, not allowing the drive mechanism to be switched to a lower speed.

4. The method as set forth in claim 1 and including sensing the ambient temperature and if it exceeds a predetermined threshold temperature, not allowing the drive mechanism to be switched to a lower speed operation.

5. The method as set forth in claim 1 and including reducing the speed of said drive mechanism only after a predetermined time period has elapsed.

6. An apparatus for controlling the speed of a drive mechanism for a generator supplying electrical power to components of a refrigeration system comprising:

a current sensing device installed in a circuit between the generator and the refrigeration system for sensing the current being delivered to the refrigeration system; and a control responsive to said current sensing device for reducing the speed of said drive mechanism when the sensed current level is determined to be below a predetermined upper threshold, wherein said control is adapted to initiate a timer and, if the sensed current condition does not persist for a predetermined period of time, determining that it was transient caused and preventing the changing of speed for that reason.

7. The apparatus as set forth in claim 6 wherein said control sets the engine at either of a higher or a lower speed and further wherein said control is adapted to starting the drive mechanism at the higher speed.

8. The apparatus as set forth in claim 6 wherein said control is responsive to said current sensing device for reducing the speed of said drive mechanism when the sensed current level is determined to be below a predetermined upper threshold and not allowing the drive mechanism to be switched to a reduced speed if the sensed current level is determined to be less than a predetermined lower threshold.

9. The apparatus as set forth in claim 6 and including a sensor for sensing the ambient temperature and sending a responsive signal to said control, and further wherein if said responsive signal exceeds a predetermined temperature threshold signal, said control is adapted to prevent the switching to a lower speed operation.

10. The apparatus as set forth in claim 6 wherein said control is adapted to initiate a timer and reduce the speed of said drive mechanism only after a predetermined time period has elapsed.

11. The apparatus as set forth in claim 6 and including a unit which if selected, causes the control to not function in the manner as recited.

* * * * *